US009663271B2

(12) United States Patent
Verma

(10) Patent No.: US 9,663,271 B2
(45) Date of Patent: May 30, 2017

(54) BISTABLE PULL-SNAP HOLD OPEN MECHANISM AND METHOD

(71) Applicant: Vishaal B. Verma, Evanston, IL (US)

(72) Inventor: Vishaal B. Verma, Evanston, IL (US)

(73) Assignee: ProAmpac Intermediate, Inc., Cincinnati, OH (US)

( * ) Notice: Subject to any disclaimer, the term of this patent is extended or adjusted under 35 U.S.C. 154(b) by 653 days.

(21) Appl. No.: 13/943,601

(22) Filed: Jul. 16, 2013

(65) Prior Publication Data

US 2014/0014789 A1 Jan. 16, 2014

Related U.S. Application Data

(60) Provisional application No. 61/741,259, filed on Jul. 16, 2012.

(51) Int. Cl.

| | |
|---|---|
| ***B65B 67/04*** | (2006.01) |
| ***B65D 33/00*** | (2006.01) |
| ***B65D 33/02*** | (2006.01) |

(52) U.S. Cl.

CPC ..... *B65D 33/007* (2013.01); *B65D 33/02* (2013.01)

(58) Field of Classification Search

CPC ..... B65D 33/007; B65D 33/02

USPC ..... 383/43, 63, 107, 33, 35; 248/99; 24/30.5 R

IPC ..... B65D 33/007,33/02

See application file for complete search history.

(56) References Cited

U.S. PATENT DOCUMENTS

| | | | |
|---|---|---|---|
| 199,507 | A | 1/1878 | Brubaker |
| 1,463,113 | A | 7/1923 | Bibb |
| 1,887,940 | A | 11/1932 | Marinsky |
| 2,008,314 | A | 7/1935 | Russell |

(Continued)

FOREIGN PATENT DOCUMENTS

| | | | |
|---|---|---|---|
| EP | 2112085 | A1 | 10/2009 |
| GB | 189726598 | A | 11/1898 |

(Continued)

OTHER PUBLICATIONS

International Search Report and Written Opinion of the International Searching Authority, received for International Patent Application No. PCT/US2014/035154, mailed Aug. 29, 2014 (12 pages).

(Continued)

*Primary Examiner* — Gwendolyn Baxter
(74) *Attorney, Agent, or Firm* — Perman & Green, LLP

(57) ABSTRACT

One embodiment relates to a bistable hold open mechanism including first and second flexible flat, strip like members positioned relative to each other. The members include opposing first and second ends; an inner mating surface; and an opposing outer bonding surface. One or more pivot members and/or hinges is integrated into the second member separating it into a side seal portion and an operable portion, the side seal portion coupled to the operable portion. Embodiments include flexures which allow the pivot members or hinges to be biased in open or closed configurations. Applying a slight pressure to the members opens the mechanism. When the mechanism reaches a predetermined point, the pivot or hinges lock, maintaining an open configuration. Closing the mechanism only requires a slight pressure be applied to the external surface of the members, resulting in the pivot members or hinges unlocking and rotating towards a closed configuration.

15 Claims, 3 Drawing Sheets

(56) References Cited

U.S. PATENT DOCUMENTS

| | | | | |
|---|---|---|---|---|
| 2,040,271 | A | 5/1936 | Rozenweig | |
| 2,064,696 | A * | 12/1936 | Smith | A01K 97/20 224/406 |
| 2,074,843 | A | 5/1937 | Hiering | |
| 2,142,904 | A | 1/1939 | Lamarthe | |
| 2,150,627 | A | 3/1939 | Lieber | |
| 2,158,955 | A * | 5/1939 | Blacber | A45C 13/06 16/277 |
| 2,578,612 | A * | 12/1951 | Stregack | A45C 13/04 150/120 |
| 2,693,212 | A | 11/1954 | Guichard | |
| 3,310,224 | A | 3/1967 | Laguerre | |
| 3,313,469 | A | 4/1967 | Drozda | |
| 4,069,994 | A | 1/1978 | Wharmby | |
| 4,479,244 | A * | 10/1984 | Ausnit | B65D 33/2508 383/63 |
| 4,486,923 | A | 12/1984 | Briggs | |
| 4,664,348 | A | 5/1987 | Corsaut, III et al. | |
| 4,753,367 | A | 6/1988 | Miller et al. | |
| 4,753,489 | A | 6/1988 | Mochizuki | |
| 4,758,099 | A | 7/1988 | Branson | |
| 4,815,866 | A | 3/1989 | Martone | |
| 4,848,930 | A | 7/1989 | Williams et al. | |
| 5,035,518 | A | 7/1991 | McClintock | |
| 5,037,138 | A | 8/1991 | McClintock et al. | |
| 5,044,774 | A | 9/1991 | Bullard et al. | |
| 5,082,219 | A | 1/1992 | Blair | |
| 5,183,227 | A | 2/1993 | Wilhite | |
| 5,184,896 | A | 2/1993 | Hammond et al. | |
| 5,524,990 | A | 6/1996 | Buck | |
| 5,609,419 | A | 3/1997 | Byers, Jr. | |
| 5,676,306 | A | 10/1997 | Lankin et al. | |
| 5,716,138 | A | 2/1998 | Southwell | |
| 6,022,144 | A | 2/2000 | Hausslein | |
| 6,149,304 | A | 11/2000 | Hamilton et al. | |
| 6,164,821 | A | 12/2000 | Randall | |
| 6,231,235 | B1 | 5/2001 | Galomb et al. | |
| 6,234,674 | B1 | 5/2001 | Byers, Jr. | |
| 6,234,676 | B1 | 5/2001 | Galomb et al. | |
| 6,273,608 | B1 | 8/2001 | Ward et al. | |
| 6,345,911 | B1 | 2/2002 | Young et al. | |
| 6,508,587 | B1 | 1/2003 | Byers, Jr. | |
| 6,572,267 | B1 | 6/2003 | Forman | |
| 6,578,585 | B1 | 6/2003 | Stachowski et al. | |
| 6,678,923 | B2 | 1/2004 | Goldberg et al. | |
| 6,899,460 | B2 | 5/2005 | Turvey et al. | |
| 6,904,647 | B2 | 6/2005 | Byers, Jr. | |
| 7,347,623 | B2 | 3/2008 | Cawley | |
| 7,416,337 | B2 | 8/2008 | Munch-Fals | |
| 7,681,784 | B2 | 3/2010 | Lang | |
| 8,333,351 | B2 | 12/2012 | Kramer | |
| 8,474,623 | B2 * | 7/2013 | Villarrubia | B65D 31/02 206/524.1 |
| 8,678,650 | B2 | 3/2014 | Savage | |
| 2003/0033694 | A1 * | 2/2003 | Cisek | B29D 5/10 24/401 |
| 2004/0195467 | A1 | 10/2004 | Passage | |
| 2004/0208400 | A1 | 10/2004 | Linneweil | |
| 2005/0137073 | A1 * | 6/2005 | Weaver | B65D 31/10 493/394 |
| 2005/0281487 | A1 | 12/2005 | Pawloski | |
| 2006/0010659 | A1 | 1/2006 | Penn | |
| 2006/0050999 | A1 * | 3/2006 | Blythe | B65D 77/225 383/63 |
| 2006/0280386 | A1 | 12/2006 | Bublitz | |
| 2008/0019618 | A1 | 1/2008 | Dayton et al. | |
| 2009/0046955 | A1 | 2/2009 | Schember et al. | |
| 2011/0188785 | A1 * | 8/2011 | Turvey | B65D 33/16 383/34 |
| 2011/0226914 | A1 | 9/2011 | Fleming | |
| 2012/0138623 | A1 | 6/2012 | Verma | |
| 2013/0064480 | A1 | 3/2013 | Verma | |
| 2013/0248541 | A1 | 9/2013 | Verma | |
| 2014/0014789 | A1 | 1/2014 | Verma | |
| 2014/0259868 | A1 | 4/2014 | Verma | |
| 2014/0314342 | A1 | 10/2014 | Verma | |

FOREIGN PATENT DOCUMENTS

| | | | |
|---|---|---|---|
| JP | 51-017122 | U | 2/1976 |
| JP | 2000-085905 | A | 3/2000 |
| JP | 2003-072779 | A | 3/2003 |
| WO | 99/00312 | A1 | 1/1999 |

OTHER PUBLICATIONS

International Search Report and Written Opinion of the International Searching Authority, received for International Patent Application No. PCT/US2012/068314, mailed Mar. 14, 2013 (6 pages).
International Search Report and Written Opinion of the International Searching Authority, received for International Patent Application No. PCT/US2011/062840, mailed Apr. 23, 2012 (6 pages).
U.S. Patent and Trademark Office Non-final Office Action, received for U.S. Appl. No. 12/958,217, mailed Nov. 6, 2012 (7 pages).
U.S. Patent and Trademark Office Final Office Action, received for U.S. Appl. No. 12/958,217, mailed Apr. 12, 2013 (10 pages).
U.S. Patent and Trademark Office Non-final Office Action, received for U.S. Appl. No. 13/485,773, mailed Nov. 3, 2014 (12 pages).
Impact Advanced Concepts, "Snap Span" earliest available publication Apr. 8, 2012 at https://web.archive.org/web/20120408231153/http://www.snap-span.com/ downloaded Apr. 29, 2014 (2 pages).
Jokari Baggy Rack, "Baggy Rack Pro" earliest available publication Nov. 15, 2012 at https://web.archive.org/web/20121115010901/http://www.jokari.com/products/G_169606.html downloaded Apr. 29, 2014 (1 page).
U.S. Patent and Trademark Office Final Office Action, received for U.S. Appl. No. 14/259,868, mailed Jul. 9, 2015 (12 pages).
Office Action from the United States Patent and Trademark Office for U.S. Appl. No. 13/786,068 dated Apr. 13, 2015 (12 pages).

* cited by examiner

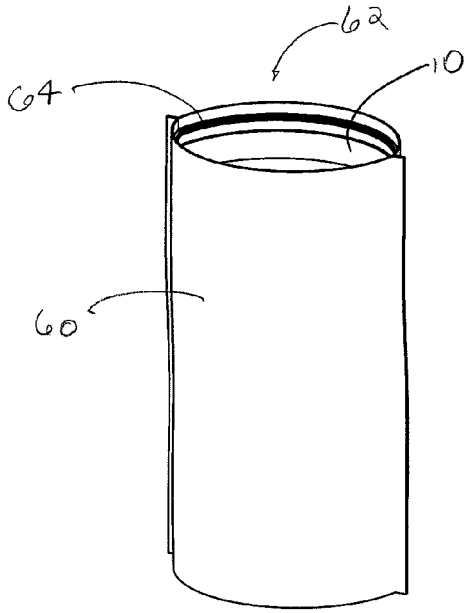
Fig. 7
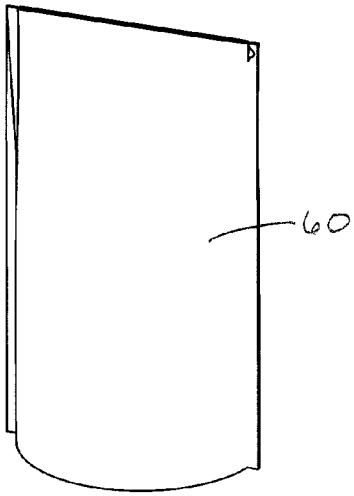
Fig. 8
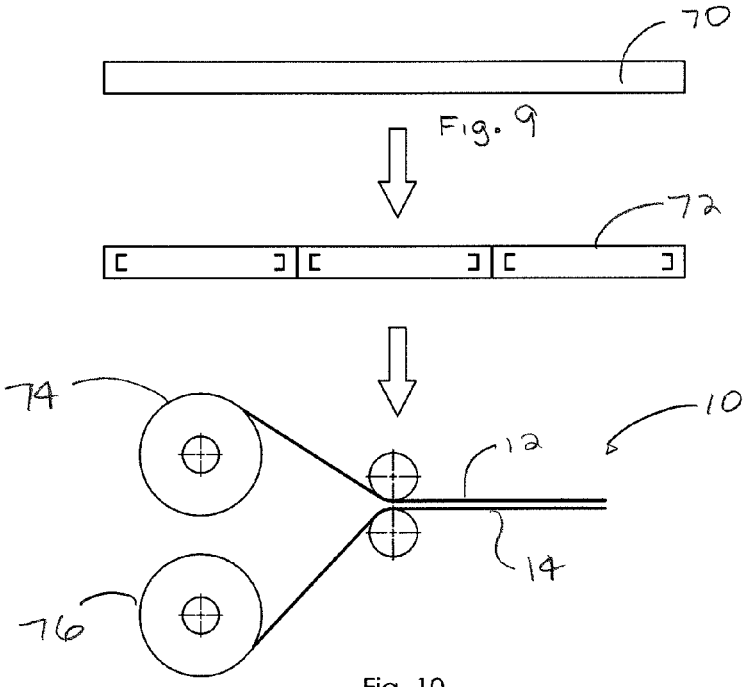
Fig. 9
Fig. 10

BISTABLE PULL-SNAP HOLD OPEN MECHANISM AND METHOD

CROSS-REFERENCE TO RELATED APPLICATIONS

This application claims the benefit of U.S. Provisional Application Ser. No. 61/741,259 filed Jul. 16, 2012, the complete subject matter of which is incorporated herein by reference in its entirety.

FIELD OF THE INVENTION

The invention relates to a hold open mechanism. More particularly, embodiments relate to a hold open mechanism used with a package, bag, or container and a method of accessing a package, bag, or container having hold open mechanism.

BACKGROUND OF THE INVENTION

Pliable containers are widely used to store both edible and non-edible products. For example, snack items, such as various types of chips and cereals, are typically packaged in pliable containers. These containers are generally sealed at both ends for initial packaging purposes and then one end is opened to access the product. It may be desirable to reuse the container to store the product for extended periods of time, allowing repeated access to the interior of the container.

When used to store edible food items for example, it is particularly advantageous to adequately seal the open end of the container between uses in order to prolong the useful life of the products stored therein. For this reason, once the initial seal at one end of the container is broken, it is common practice to roll up the openable end of the pliable container for storage. Unfortunately, the rolled-up ends of such pliable containers generally tend to unroll between uses, which may lead to the food items becoming stale or non-edible.

Proposed solutions to this problem include providing various types of closure mechanisms at the open end of the container to maintain the side walls of the container in a closed relationship for sealing purposes. For example, it is known to use a clip to prevent the openable container end from unrolling. Since such clips are completely separate from the container, they can be misplaced and are therefore often only used when readily available. In addition, these clips often tend to break and only directly maintain a small central section of the openable container end in a rather tight, closed condition. Zip-type or slider type closure arrangements have also become quite prevalent for use with certain types of pliable containers. Such closure arrangements are considered advantageous in that they generally extend across the entire width of the open end and are formed integral to the container. However, such closure arrangements alone do not enhance the accessibility to the interior of a container when the container is opened. More specifically, such closure arrangements do not maintain the side walls of the container in an open position, at least at the open end of the container, to permit easy access to the contents.

For the foregoing reasons, there is a need for a simple, inexpensive hold open mechanism for use with pliable containers that will enhance accessibility in the open position while not inhibiting or preventing resealing functionality in the closed or sealed position.

SUMMARY OF THE INVENTION

One embodiment relates to a bistable pull-snap hold open mechanism that allows a user to easily access the contents of a flexible package. It's designed to fit proximate the opening of a package generally complimenting the functionality of a zip type closure. The device is comprised of a first and second flat strip like member coupled by one or more locking or bistable hinge mechanisms. The locking hinge mechanisms generally include a standard living hinge in addition to one or more spring flaps or flexures which allow the hinge to be biased in an open or closed configuration. When the user wishes to open the package and hold it in this configuration, all that is required is a slight pressure applied to the side walls of the package. When the mechanism reaches a certain point, the hinges lock thus maintaining the sidewalls of the container in an open configuration. When the user wishes to close the mechanism, a slight pressure applied to the external surface of the sidewalls inwards results in the hinges unlocking and rotating towards a closed configuration. The user can then use the zip-type closure to seal the package.

Another embodiment relates to a tape feed bistable hold open mechanism including a flexible first flat, strip like member comprised of a polyolefin material and a flexible second flat, strip like member positioned relative to the first flat strip like member, the second flat, stripe like member comprised of a polyolefin. The first flat, strip like member includes a first end; a second end opposite the first end; an inner mating surface; and an outer bonding surface opposite the inner mating surface. The second flat, strip like member includes a first end; a second end opposite the first end; an inner mating surface; and an outer bonding surface opposite the inner mating surface. One or more pivot members is integrated into the second flat, strip like member separating the second flat, strip like member into a side seal portion and an operable portion, the side seal portion coupled to the operable portion.

Still another embodiment relates to a method of using the tape feed hold open mechanism. The method comprises applying a separating pressure between the first flat, strip like member and second flat, strip like member; sliding the flexure from a first flat configuration to a second bent configuration, holding the first member separate from the second member allowing easy access to the contents of the package; applying a compressive pressure between the first and second member; and sliding the flexure from a second bent configuration to a first flat configuration thus closing and mating the first member relative to the second member.

One other embodiment relates to a fitment bistable hold open mechanism, comprising a flexible first flat, strip like member comprised of a polyolefin material and a flexible second flat, strip like member positioned relative to the first flat strip like member, the second flat, stripe like member comprised of a polyolefin. The flexible first flat, strip like member has an inner mating surface; an outer bonding surface opposite the inner mating surface. The flexible second flat, strip like member positioned relative to the first flat strip like member, the second flat, stripe like member has a first edge; an inner mating surface; an outer bonding surface opposite the inner mating surface; one or more pivot members pivotally coupling the first flat, strip like member to the second, flat strip like member.

Still one other embodiment relates to a method of using the fitment bistable hold open mechanism includes applying a separating pressure between the first flat, strip like member and second flat, strip like member; sliding the flexure from a first closed and disengaged configuration to a second open and engaged configuration, holding the first member separate from the second member allowing easy access to the contents of the package; applying a compressive pressure between the first and second member; and sliding the flexure from a second open and engaged configuration to a first closed and disengaged configuration thus closing and mating the first member relative to the second member.

Embodiments include flexures which allow the pivot members or hinges to be biased in open or closed configurations. Applying a slight pressure to the members opens the mechanism. When the mechanism reaches a predetermined point, the pivot or hinges lock, maintaining an open configuration. Closing the mechanism only requires a slight pressure be applied to the external surface of the members, resulting in the pivot members or hinges unlocking and rotating towards a closed configuration.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

FIG. 7 is a side view of the fitment style pull-snap open mechanism mounted to a package in an open position in accordance with one embodiment;

FIG. 8 is a side view of the fitment style pull-snap open mechanism mounted to a package in a closed position in accordance with one embodiment;

FIG. 9 illustrates the tape feed pull-snap hold open mechanism starting as a homogeneous tape in accordance with one embodiment FIG. 10 illustrates the tape feed manufacturing method in accordance with one embodiment;

Throughout the various figures, like reference numbers refer to like elements.

DETAILED DESCRIPTION

Embodiments of the present invention are designed to augment the functionality of the conventional zip type closure mechanism. The bistable pull-snap hold open mechanism allows a user to easily access the contents of a flexible package. It's designed to fit proximate the opening of a package generally complimenting the functionality of a zip type closure. The device is comprised of a first and second flat strip like member coupled by one or more locking or bistable hinge mechanisms. The locking hinge mechanisms generally include a standard living hinge in addition to one or more spring flaps or flexures which allow the hinge to be biased in an open or closed configuration. When the user wishes to open the package and hold it in this configuration, all that is required is a slight pressure applied to the side walls of the package. When the mechanism reaches a certain point, the hinges lock thus maintaining the sidewalls of the container in an open configuration. When the user wishes to close the mechanism, a slight pressure applied to the external surface of the sidewalls inwards results in the hinges unlocking and rotating towards a closed configuration. The user can then use the zip-type closure to seal the package.

Figure 1:
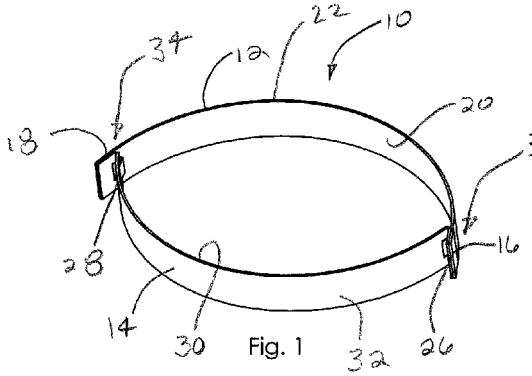
FIG. 1 is an isometric view of the tape feed style pull-snap hold open mechanism in an open position in accordance with one embodiment.
Figure 2:
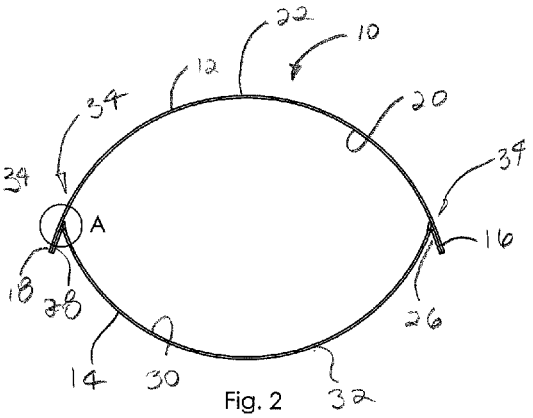
FIG. 2 is a top view of the hold open mechanism of FIG. 1 in an open position in accordance with one embodiment.

More particularly, FIGS. 1-2 depict views of the tape feed bistable hold open mechanism, generally designated 10, in accordance with one embodiment of the present invention, depicting the hold open mechanism 10 in a first or open position. In the illustrated embodiment, the hold open mechanism 10 includes at least a generally flexible first flat, strip like member 12 and a generally flexible second flat, strip like member 14. In at least one embodiment, the first flat, strip like member 12, the second, flat strip like member 14 or both are comprised of a polyolefin material. It should be realized that, while polyolefin material is discussed, other materials and combinations are also contemplated.

As illustrated, the first flat, strip like member 12 has a first orientation defined with respect to a length of the second flat, strip like member 14, a first end 16, a second end 18 opposite the first end 16, an inner mating surface 20, and an outer bonding surface 22 opposite the inner mating surface 20. Similarly, the second flat, strip like member 14 has a first orientation defined with respect to a length of the first flat, strip like member 12, a first end 26 proximate end 16, a second end 28 opposite the first end 26 and proximate end 18, an inner mating surface 30, and an outer bonding surface 32 opposite the inner mating surface 30.

The hold open mechanism 10 further includes one or more pivot members 34 integrated into the second flat, strip like member 14. In at least one embodiment, the one or more pivot members 34 separates the second flat, strip like member 14 into a side seal portion 36 and an operable portion 38, where the side seal portion 36 is coupled to the operable portion 38 (best viewed in FIGS. 5 and 6).

Figure 3:
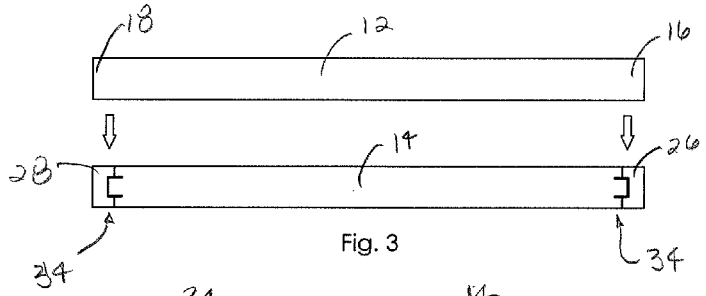
FIG. 3 is an exploded view of the first member and second member of the hold open mechanism of FIG. 1 in accordance with one embodiment.
Figure 4:
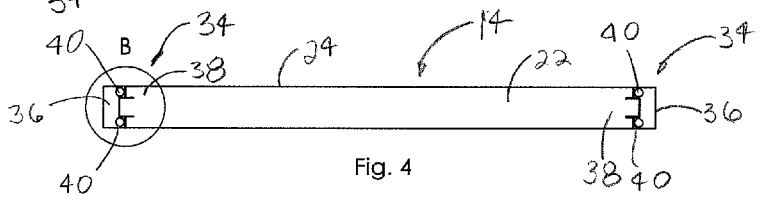
FIG. 4 is view of the second member of FIG. 3 illustrating the bonding points of the hold open mechanism of FIG. 1 in accordance with one embodiment.

FIG. 3 depicts an exploded view of the first member 12 and second member 14 of the hold open mechanism 10 in accordance with one embodiment. FIG. 3 depicts the one or more pivot members 34 integrated into the second member 14. FIG. 4 depicts a front view of the second member 14 illustrating bonding points 40 of the hold open mechanism 10. In at least one embodiment, first member 12 and second member 14 are joined, connected or bonded along or at one or more of the bonding points 40. More specifically, inner mating surface 20 is joined, connected or bonded to inner mating surface 30. More specifically the first member 12 is bonded to the second member 14 forming the hold open mechanism 10, the side seal portion 36 of the second member 14 is bonded to the ends 16, 18 of the first member 12 using any method known in the art including heat sealing, spot sealing, ultrasonic welding, adhesive bonding and the like.

Figure 5:
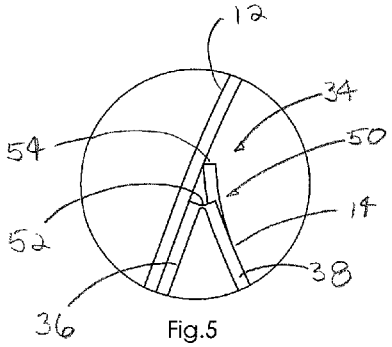
FIG. 5 is an enlarged view of the detail A of FIG. 1 illustrating the flexure in accordance with one embodiment.
Figure 6:
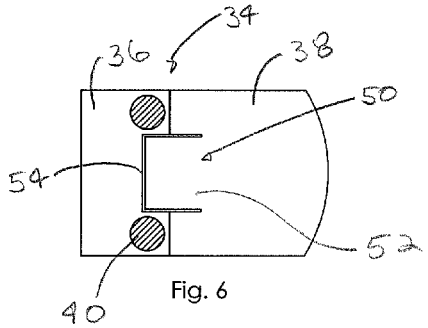
FIG. 6 is an enlarged view of the detail B of FIG. 4 illustrating the bonding in accordance with one embodiment.

The one or more pivot members 34 are illustrated in greater detail in FIGS. 5-6, where FIG. 5 depicts an enlarged view of the detail A of FIG. 1 while FIG. 6 depicts an enlarged view of the detail B of FIG. 4. In at least one embodiment, the one or more pivot members comprise a living hinge. More specifically the one or more pivot members 34 comprises a living hinge defined by a thin portion of material coupling outer end corners of the side seal portion 36 and the operable portion 38 of the second member 14.

In at least one embodiment of the hold open mechanism 10 the one or more pivot member comprises a living hinge created by indenting, engraving, or slitting the surface of the strip like material of the second member 14 to a specified blind depth, forming one or more flexures 50. In at least one embodiment, the one or more flexures 50 are integrated into the second member 14 proximate the pivot member, where the one or more flexures 50 are rigidly coupled to the operable portion 38 of the second member 14 including a flexing point 52 parallel with that of the pivot member allowing the flexure 50 to move from a first flat configuration (best viewed in FIGS. 3 and 6) to a second bent or flexed configuration (best viewed in FIG. 5).

As illustrated in FIG. 5, the one or more flexures 50 includes a sliding edge 54 generally parallel with that of the pivot member which engages the surface of the first member 12. A second configuration of the flexure 50 holds the operable portion 38 of the second member 14 in a separated orientation relative to that of the first member 12, where the mating surfaces are generally between about 90 degrees and 180 degrees of separation relative to one another. The body of the flexure 50 intersects the pivot member, where the one or more flexures 50 created by punching or cutting the surface of the strip like material of the second member 14 to a through depth.

FIGS. 7 and 8 depict the hold open mechanism 10 mounted to a package 60. FIG. 7 depicts the hold open mechanism 10 holding the package 60 in an open position in accordance with one embodiment, while FIG. 8 depicts the package 60 in a closed. In at least one embodiment the hold open mechanism 10 is used with a reclosable or resealable mechanism 64 such as a zip type closure and the like to secure the package 60.

FIG. 10 illustrates one embodiment of a method of manufacturing or producing the hold open mechanism 10. In at least one embodiment, the first flat, strip like member 12 and the second flat, strip like member 14 are applied proximate the opening 62 of a package 60 as a tape. The first flat, strip like member material 12 is fed as a homogeneous tape 70 as shown in FIG. 9 into a die cutting apparatus where all required cutting, slitting, engraving features are cut into the material. The second flat, strip like member material 14 is similarly fed as a homogeneous tape 70 into a diecutting apparatus where all required cutting, slitting, engraving features are cut into the material 72. The first member tape and second member tape are collected on bobbins 74 and 76, then joined and then bonded to each other, forming segmented hold open mechanisms 10. In at least one embodiment, the hold open mechanisms are fed into a horizontal flexible packaging forming machine or a vertical flexible packaging forming machine, forming packages 60.

A method of using the tape feed hold open mechanism 10 includes applying a separating pressure between the first flat, strip like member 12 and second flat, strip like member 14. The flexure 50 slides from a first flat configuration to a second bent configuration, holding the first member 12 separate from the second member 14. This allows easy access to the contents of the package 60. To close, a compressive pressure is applied between the first member 12 and second member 14. The flexure 50 slides from the second bent configuration to the first flat configuration, thus closing and positioning or mating the first member 12 relative to the second member 14.

The bistable pull-snap hold open mechanism allows a user to easily access the contents of a flexible package. It's designed to fit proximate the opening of a package generally complimenting the functionality of a zip type closure. The device is comprised of a first and second flat strip like member coupled by one or more locking or bistable hinge mechanisms. The locking hinge mechanisms generally include a standard living hinge in addition to one or more spring flaps or flexures which allow the hinge to be biased in an open or closed configuration. When the user wishes to open the package and hold it in this configuration, all that is required is a slight pressure applied to the side walls of the package. When the mechanism reaches a certain point, the hinges lock thus maintaining the sidewalls of the container in an open configuration. When the user wishes to close the mechanism, a slight pressure applied to the external surface of the sidewalls inwards results in the hinges unlocking and rotating towards a closed configuration. The user can then use the zip-type closure to seal the package.

Figure 11:
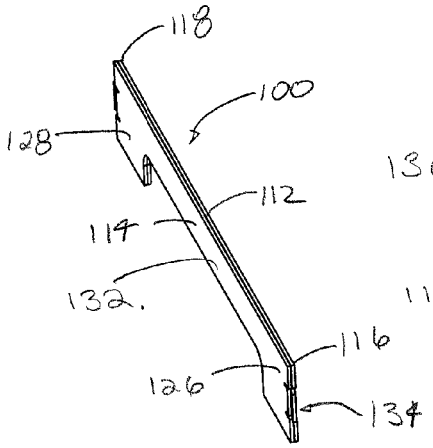
FIG. 11 is an isometric view of the fitment style pull-snap hold open mechanism in an closed position in accordance with one embodiment.
Figure 12:
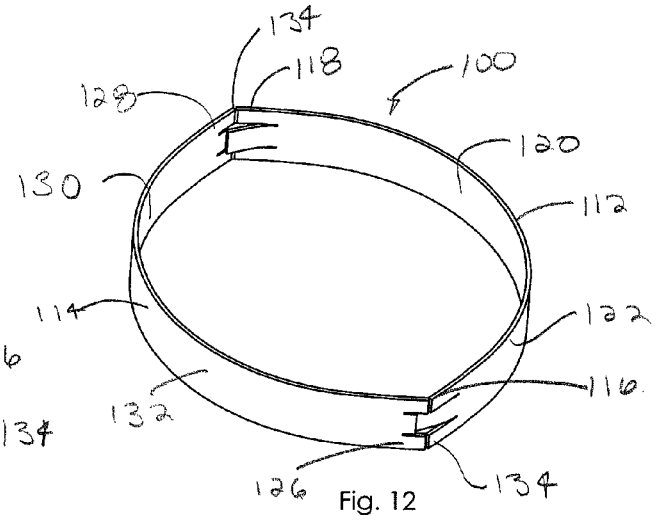
FIG. 12 is a isometric top view of the hold open mechanism of FIG. 11 in an open position in accordance with one embodiment.

FIGS. 11-12 depict isometric views of a fitment bistable hold open mechanism, generally designated 100, in accordance with one embodiment of the present invention, depicting the hold open mechanism 100 in a first or open position (FIG. 2) and a second or closed position (FIG. 1). In the illustrated embodiment, the hold open mechanism 100 includes at least a generally flexible first flat, strip like member 112 and a generally flexible second flat, strip like member 114. In at least one embodiment, the first flat, strip like member 112, the second, flat strip like member 114 or both are comprised of a polyolefin material. It should be realized that, while polyolefin material is discussed, other materials or combinations are also contemplated.

As illustrated, the first flat, strip like member 112 has a first orientation defined with respect to a length of the second flat, strip like member 114, a first end 116, a second end 118 opposite the first end 116, an inner mating surface 120, and an outer bonding surface 122 opposite the inner mating surface 120. Similarly, the second flat, strip like member 114 has a first orientation defined with respect to a length of the first flat, strip like member 112, a first end 126 proximate end 116, a second end 128 opposite the first end 126 and proximate end 118, an inner mating surface 130, and an outer bonding surface 132 opposite the inner mating surface 130.

The hold open mechanism 100 further includes one or more pivot members 134 pivotably coupling the first flat, strip like member 112 to the second, flat strip like member 114 (best viewed in FIGS. 11 and 12). In at least one embodiment, the one or more pivot members comprises a living hinge defined by a thin portion of material coupling the inner end corners of the first member 112 and second member 114 (best viewed in FIGS. 13 and 14).

The hold open mechanism 100 further includes a flexure group 150 having a longer primary flexure 156 and a shorter secondary flexure 158 where the primary flexure 156 engages with the secondary flexure 158 when the mechanism is moved from closed configuration to an open configuration.

Figure 13:
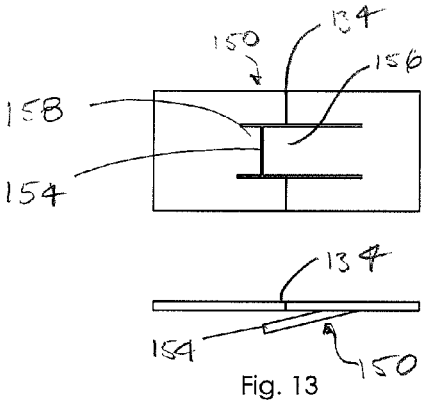
FIG. 13 is an enlarged top and side view of the flexure of FIG. 11 illustrating the flexure starting from an initial slightly bent orientation in accordance with one embodiment.
Figure 14:
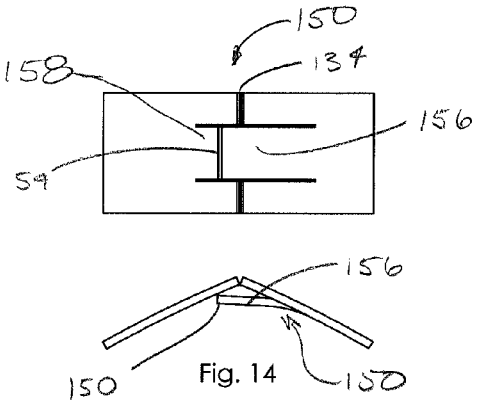
FIG. 14 is an enlarged top and side view of the sliding edge of the flexure of FIG. 11 with the hold open mechanism in an open and engaged configuration in accordance with one embodiment.

FIG. 13 depicts an enlarged top and side view of the primary flexure 156 and secondary flexure 158 of FIG. 11, while FIG. 14 is an enlarged top and side view of the sliding edge of the primary flexure 156 of FIG. 11 with the hold open mechanism 100 in an open configuration in accordance with one embodiment.

In at least one embodiment of the hold open mechanism 100 the one or more pivot member comprises a living hinge created by indenting, engraving, or slitting the surface of the strip like material to a specified blind depth, forming one or more flexures 150. In at least one embodiment, the one or more primary flexures are integrated into the second member 114 proximate the pivot member 134, allowing the primary flexure 156 to move from a first closed and disengaged configuration (best viewed in FIG. 13) to a second open or engaged configuration (best viewed in FIG. 4).

As illustrated in FIG. 13-14, the one or more primary flexures 156 includes a sliding edge 154 generally parallel with that of the pivot member 134 which engages the surface of the secondary flexure 158. A second configuration of the flexure group 150 holds the second member 114 in a separated orientation relative to that of the first member 112, where the mating surfaces are generally between about 90 degrees and 180 degrees of separation relative to one another. The body of the primary flexure 156 intersects the pivot member 134, where the one or more flexures 150 created by punching or cutting the surface of the strip like material of the second member 114 to a through depth.

FIGS. 7 and 8 depict the hold open mechanism 10 mounted to a package 60. It is contemplated that the hold open mechanism 100 may be used in a similar fashion, holding the package 60 in an open position in accordance with one embodiment as illustrated in FIG. 7. In at least one embodiment the hold open mechanism 100 is used with a reclosable or resealable mechanism 64 such as a zip type closure and the like to secure the package 60.

Figure 15:
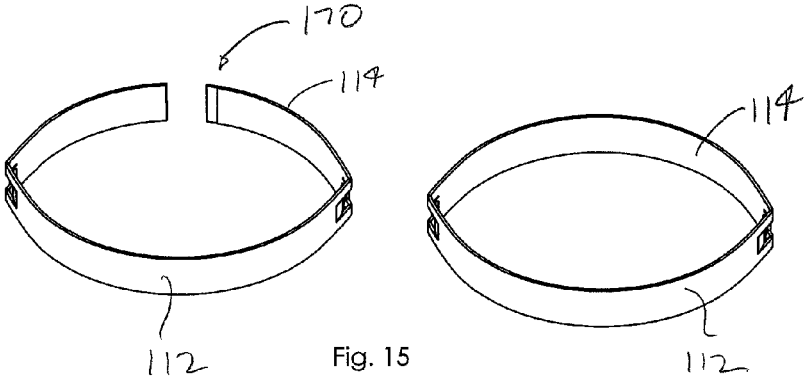
FIG. 15 illustrates the manufacturing method of making the fitment in accordance with one embodiment.

FIG. 15 illustrates one embodiment of a method of manufacturing or producing the hold open mechanism 100. In at least one embodiment, the first flat, strip like member 112 and the second flat, strip like member 114 are applied proximate the opening of a package 60 as a fitment, the first and second flat, strip like member material fed as a homogeneous tape into a diecutting apparatus where all required cutting, slitting, engraving features are cut into the material. One or more separation points 170 are cut into the material. The separation points 170 are bonded, forming segmented hold open mechanisms and fed into a horizontal flexible packaging forming machine or a vertical flexible packaging forming machine.

A method of using the fitment bistable feed hold open mechanism 100 includes applying a separating pressure between the first flat, strip like member 112 and second flat, strip like member 114. The flexure 150 slides from a first closed and disengaged configuration to a second open and engaged configuration, the first member 112 separate from the second member 114. This allows easy access to the contents of the package 60. To close, a compressive pressure is applied between the first member 112 and second member 114. The flexure 150 slides from the second bent configuration to the first flat configuration, thus closing and positioning or mating the first member 112 relative to the second member 114.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. A tape feed bistable hold open mechanism, comprising:

a flexible first flat strip comprised of a polyolefin material having:
- a first end;
- a second end opposite the first end;
- an inner mating surface;
- an outer bonding surface opposite the inner mating surface;

a flexible second flat strip positioned relative to the first flat strip, the second flat strip comprised of a polyolefin having:
- a first end;
- a second end opposite the first end;
- an inner mating surface;
- an outer bonding surface opposite the inner mating surface;
- one or more pivot members and one or more flexures integrated into the second flat strip separating the second flat strip into a side seal portion and an operable portion, the side seal portion coupled to the operable portion, wherein the one or more pivot members and one or more flexures are proximate, wherein the one or more flexures are rigidly coupled to the operable portion of the second flat strip and include a flexing point parallel with that of the pivot member allowing the flexure to move from a first flat configuration to a second bent, flexed, or engaged configuration, and wherein the one or more flexures includes a sliding edge generally parallel with that of the pivot member which engages the surface of the first flat strip, a second configuration of the flexure holding the operable portion of the second flat strip in a separated orientation relative to that of the first member where the mating surfaces are generally between about 90 degrees and 180 degrees of separation relative to one another, the body of the flexure intersecting the pivot member, the one or more flexures created by punching or cutting the surface of the second flat strip to a through depth.

2. The tape feed hold open mechanism of claim 1 wherein the one or more pivot members comprises a living hinge.

3. The tape feed hold open mechanism of claim 1 wherein the one or more pivot members comprises a living hinge defined by a thin portion of material coupling outer end corners of the side seal portion and the operable portion of the second flat strip.

4. The tape feed hold open mechanism of claim 1 wherein the one or more pivot members comprise a living hinge created by indenting, engraving, or slitting the surface of the second flat strip to a specified blind depth.

5. The tape feed hold open mechanism of claim 1 wherein the first flat strip is bonded to the second flat strip forming a hold open mechanism, the side seal portion of the second flat strip bonded to the end of the first flat strip using any method known in the art including heat sealing, spot sealing, ultrasonic welding, or adhesive bonding.

6. The tape feed hold open mechanism of claim 1 wherein the first flat strip and the second flat strip are applied proximate the opening of a package as a tape, the first flat strip material fed as a homogeneous tape into a diecutting apparatus where all required cutting, slitting, engraving features are cut into the material, the second flat strip material fed as a homogeneous tape into the diecutting apparatus where all required cutting, slitting, engraving features are cut into the material, the first flat strip and second flat strip tape are joined, then bonded to each other forming segmented hold open mechanisms and fed into a horizontal flexible packaging forming machine or a vertical flexible packaging forming machine.

7. The tape feed hold open mechanism of claim 1 wherein the first flat strip and the second flat strip are applied proximate the opening of a package, the package further including a zip closure.

8. A fitment bistable hold open mechanism, comprising:

a flexible first flat strip comprised of a polyolefin material having:

an inner mating surface;

an outer bonding surface opposite the inner mating surface;

a flexible second flat strip positioned relative to the first flat strip, the second flat stripe comprised of a polyolefin having:

an inner mating surface;

an outer bonding surface opposite the inner mating surface;

one or more pivot members pivotally coupling the first flat strip to the second flat strip; and one or more primary flexures proximate the one or more pivot members, wherein the one or more primary flexures rigidly coupled to the second flat strip include a flexing point parallel with that of the pivot member allowing the primary flexure to move from a first closed and disengaged configuration to a second open and engaged configuration, the primary flexure extending beyond the pivot member when in the closed and disengaged configuration, the body of the primary flexure intersecting the pivot member, the primary flexure slightly bent at an angle generally 5-10 degrees away from the outer bonding surface of the second flat strip, and wherein the one or more primary flexures includes a sliding edge generally parallel with that of the pivot member which engages the surface of a secondary flexure, the secondary flexure rigidly coupled to the first flat strip including a flexing point parallel with that of the pivot member and generally shorter in length than the primary flexure, a second, engaged configuration of the primary and secondary flexure holding the second flat strip in a separated orientation relative to that of the first flat strip where the mating surfaces are generally between about 90 degrees and 180 degrees of separation relative to one another, the one or more primary and secondary flexures created by punching or cutting the surface of the first flat strip and second flat strip to a through depth.

9. A method of using a tape feed hold open mechanism comprising:

providing a tape feed hold open mechanism comprising a flexible first flat strip comprised of a polyolefin material having:

a first end;

a second end opposite the first end;

an inner mating surface;

an outer bonding surface opposite the inner mating surface;

a flexible second flat strip positioned relative to the first flat strip, the second flat strip comprised of a polyolefin having:

a first end;

a second end opposite the first end;

an inner mating surface;

an outer bonding surface opposite the inner mating surface;

one or more pivot members and one or more flexures integrated into the second flat strip separating the second flat strip into a side seal portion and an operable portion, the side seal portion coupled to the operable portion, applying a separating pressure between the first flat strip and second flat strip;

sliding the one or more flexures from a first flat configuration to a second bent configuration, holding the first flat strip separate from the second flat strip allowing easy access to the contents of the package;

applying a compressive pressure between the first flat strip and second flat strip; and sliding the one or more flexures from a second bent configuration to a first flat configuration thus closing and mating the first flat strip relative to the second flat strip.

10. The fitment bistable hold open mechanism of claim 8 wherein the one or more pivot members comprises a living hinge defined by a thin portion of material coupling the inner end corners of the first flat strip and the second flat strip.

11. The fitment bistable hold open mechanism of claim 8 wherein the one or more pivot members comprises a living hinge.

12. The fitment bistable hold open mechanism of claim 8 wherein the one or more pivot members comprise a living hinge created by indenting, engraving, or slitting the surface of the second flat strip to a specified blind depth.

13. The fitment bistable hold open mechanism of claim 8 applied proximate the opening of a package as a fitment, the first and second flat strip material fed as a homogeneous tape into a die cutting apparatus where all required cutting, slitting, engraving features are cut into the material, cutting separation points into the material along any portion of the first or second flat strip, bonding the separation points, forming continuous, individual hold open mechanism fitments and fed into a horizontal flexible packaging forming machine or a vertical flexible packaging forming machine for example, dispensed, then applied and bonded to the package.

14. The fitment bistable hold open mechanism of claim 8 wherein the mechanism is applied proximate the opening of a package, the package further including a zip closure.

15. A method of using a fitment bistable hold open mechanism comprising:

providing a fitment bistable hold open mechanism comprising a flexible first flat strip comprised of a polyolefin material having:

an inner mating surface;

an outer bonding surface opposite the inner mating surface;

a flexible second flat strip positioned relative to the first flat strip, the second flat stripe comprised of a polyolefin having:

an inner mating surface;

an outer bonding surface opposite the inner mating surface;

one or more pivot members pivotally coupling the first flat strip to the second flat strip, and one or more flexures proximate the one or more pivot members;

applying a separating pressure between the first flat strip and second flat strip;

sliding the one or more flexures from a first closed and disengaged configuration to a second open and engaged configuration, holding the first flat strip separate from the second flat strip allowing easy access to the contents of the package;

applying a compressive pressure between the first and second flat strip; and sliding the one or more flexures from a second open and disengaged configuration to a first closed and disengaged configuration thus closing and mating the first flat strip relative to the second flat strip.

* * * * *